US006203227B1

(12) United States Patent
Noguchi

(10) Patent No.: US 6,203,227 B1
(45) Date of Patent: Mar. 20, 2001

(54) DOUBLE CHUCK TYPE MECHANICAL PENCIL

(75) Inventor: Yoshio Noguchi, Kawagoe (JP)

(73) Assignee: Kotobuki & Co., Ltd., Kyoto-fu (JP)

( * ) Notice: Subject to any disclaimer, the term of this patent is extended or adjusted under 35 U.S.C. 154(b) by 0 days.

(21) Appl. No.: 09/496,422

(22) Filed: Feb. 2, 2000

(51) Int. Cl.[7] ..... B43K 21/22
(52) U.S. Cl. ..... 401/92; 401/67; 401/65
(58) Field of Search ..... 401/109, 67, 66, 401/92, 65

(56) References Cited

U.S. PATENT DOCUMENTS 271,439 * 1/1883 Eybel ..... 401/67
3,437,413 * 4/1969 Parker ..... 401/67
4,720,203 * 1/1988 Shimada ..... 401/67

FOREIGN PATENT DOCUMENTS

1090138 * 8/1955 (DE) ..... 401/67
7-228087 8/1995 (JP) .

* cited by examiner

*Primary Examiner*—David J. Walczak
(74) *Attorney, Agent, or Firm*—McGinn & Gibb, PLLC

(57) ABSTRACT

A double chuck type mechanical pencil comprising a lead tank 4 slidably provided within an axial tube 1, a rear chuck 5 for drawing out a lead fixedly mounted on the front end of the lead tank 4, a chuck ring 6 loosely fitted in the rear chuck 5, a rear resilient component 8 for biasing rearward the tank 4 and the rear chuck 5, a front chuck 11 for holding a lead connected to the rear chuck 5 through a connecting means 7, 9, a front resilient 10 component for biasing rearward the front chuck 11 disposed within a tip member 2 provided in the front of the axial tube 1, and a loosely fitted tube 12 at least having a stopper portion 12*b* at the rear end provided in an opening portion of the tip member 2, and thereby preventing abrasion around an opening at the extreme end of the tip member 2 caused by impingement of the front chuck 11, and not giving rise to twisting of the lead caused by rotation of the chucks 5, 11.

5 Claims, 6 Drawing Sheets

DOUBLE CHUCK TYPE MECHANICAL PENCIL

BACKGROUND OF THE INVENTION

1. Field of the Invention

This invention relates to a double chuck type mechanical pencil provided with a rear chuck for drawing out a lead in a fixed amount having a chuck ring loosely fitted thereon, and a front chuck for preventing a lead from retreating.

2. Description of the Prior Art

Conventionally, various double chuck type mechanical pencils have been proposed for mainly reducing a loss of a lead. However, in the double chuck type mechanical pencil of this kind, where a lead is held by two chucks, when one chuck is rotated for some reason, the held lead is twisted and becomes broken. In such a case as described, chips of the broken lead remain in and between the front chuck and the rear chuck to disturb the drawing-out of a lead, and when a posterior lead is pushed out after the preceding lead was broken, the broken chips of the preceding lead are deviated from the posterior lead, thereby making it impossible to draw out the posterior lead.

For overcoming such an inconvenience as described above, a double chuck type mechanical pencil has been proposed in which a rear chuck cannot be rotated, as disclosed in Japanese Patent Laid-open No. Hei 7-228087, for example.

Referring now to FIG. 1, there is illustrated the double chuck type mechanical pencil disclosed in the above publication. The double chuck type mechanical pencil comprises a tip member 22 provided in the front portion of an axial tube 21, an end chuck 25 incorporated in the tip member 22 and biased rearward in a longitudinal direction by means of a front spring 23 to hold a lead 24, and a draw-out chuck 26 positioned rearward in a longitudinal direction from the end chuck 25 to draw out the lead 24, wherein a connector 28 connected to the draw-out chuck 26 can be slidably moved in a longitudinal direction but cannot be rotated with respect to an inner sleeve 27 connected to the tip member 22.

More particularly, axially extending key ways 27*a* are formed in the inner sleeve 27, keys 28*a* of the connector 28 are engaged with the key ways 27*a* to make the draw-out chuck 26 unrotatable, and the lead 24 held between the end chuck 25 and the draw-out chuck 26 is prevented from being twisted and snapped off.

In the conventional mechanical pencil as described above, however, particularly where the tip member is formed of synthetic resin, the end chuck collides with the extreme end of the tip member during use to wear that portion, resulting in inaccuracy of fitting relative to the end chuck and raising the possibility that the mechanical pencil becomes inoperative.

Further, where the tip member is prepared with a metal having abrasion resistance, the construction of the tip member becomes complicated so that it takes time to finish an opening diameter of the tip member with accuracy by plating, etc., in terms of the outside diameter of the end chuck. Further, since a large tip member is bored to form an opening, a burr tends to occur in the opening. Accordingly, there occurs an inconvenience that accuracy of the opening diameter is low and it takes time to remove the burr so that cost increases.

Furthermore, according to the prior art, for eliminating snapping-off of a lead held between both the chucks caused by twisting thereof, detent of the rear chuck and locking or adhesion between the tip member and the axial tube are necessary, which parts are complicated in construction, posing an inconvenience that it takes time to manufacture and assemble parts, increasing the cost.

SUMMARY OF THE INVENTION

In view of the foregoing, this invention overcomes the disadvantages as noted above with respect to prior art. An object of the invention is to prevent abrasion around an opening at the extreme end of a tip member caused by impingement of a front chuck. Another object of the invention is to simplify the manufacture of the tip member so as to enhance accuracy and to be suitable for manufacture in quantity. A further object of the invention is to eliminate the complicated construction for detent of a rear chuck and provide a construction in which a front chuck is rotated together so as to eliminate snapping-off of a lead held caused by twisting as the chucks rotate. Further, since a loosely fitted tube rotates at an opening portion of the tip member, turning force will not extend to the front chuck when the tip member is removed even if locking or adhesion between the tip member and the axial tube is not provided, thus not giving rise to twisting of a lead caused by rotation of the chucks.

For achieving the aforesaid object, according to this invention, there is provided a double chuck type mechanical pencil comprising: a lead tank slidably provided within an axial tube; a rear chuck for drawing out a lead fixedly mounted on the front end of the lead tank; a chuck ring loosely fitted in the rear chuck; a rear resilient component for biasing rearward the lead tank and the rear chuck; and a front chuck for holding a lead connected to the rear chuck through a connecting means; wherein the resilient component for biasing rearward the front chuck is disposed within a tip member provided in the front of the axial tube, and a loosely fitted tube at least having a stopper portion at the rear end is provided in an opening portion of the tip member.

Further, according to a further aspect of this invention, there is provided a double chuck type mechanical pencil comprising: a front chuck for holding a lead provided at the extreme end of a tip member formed in the front of an axial tube; and a rear chuck for drawing out a lead to the front chuck by slidably moving a lead tank provided at the rear of the front chuck; wherein a loosely fitted tube is provided rotatably at the extreme end of the tip member.

Furthermore, according to another aspect of this invention, there is provided a double chuck type mechanical pencil comprising: a lead tank slidably provided within an axial tube; a rear chuck for drawing out a lead adapted to draw out a lead by slidably moving the lead tank; a chuck ring loosely fitted in the rear chuck; a rear resilient component for biasing rearward the lead tank and the rear chuck; and a front chuck for holding a lead provided in the front of the rear chuck; wherein a front resilient component for biasing rearward the front chuck is disposed within a tip member provided in the front of the axial tube, and a loosely fitted tube at least having a stopper portion at the rear end is rotatably provided in an opening portion of the tip member.

DETAILED DESCRIPTION OF THE PREFERRED EMBODIMENTS

Figure 1:
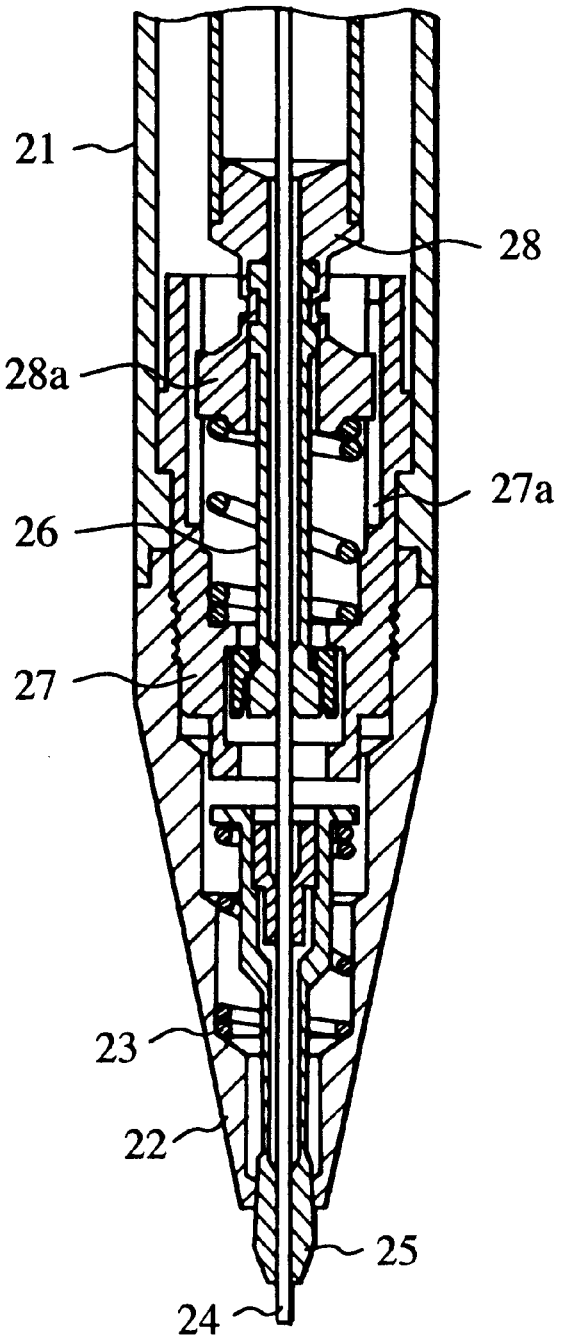
FIG.1 ( PRIOR ART )
FIG. 1 is a longitudinal sectional view of a tip member portion of a conventional double chuck type mechanical pencil.
Figure 2:
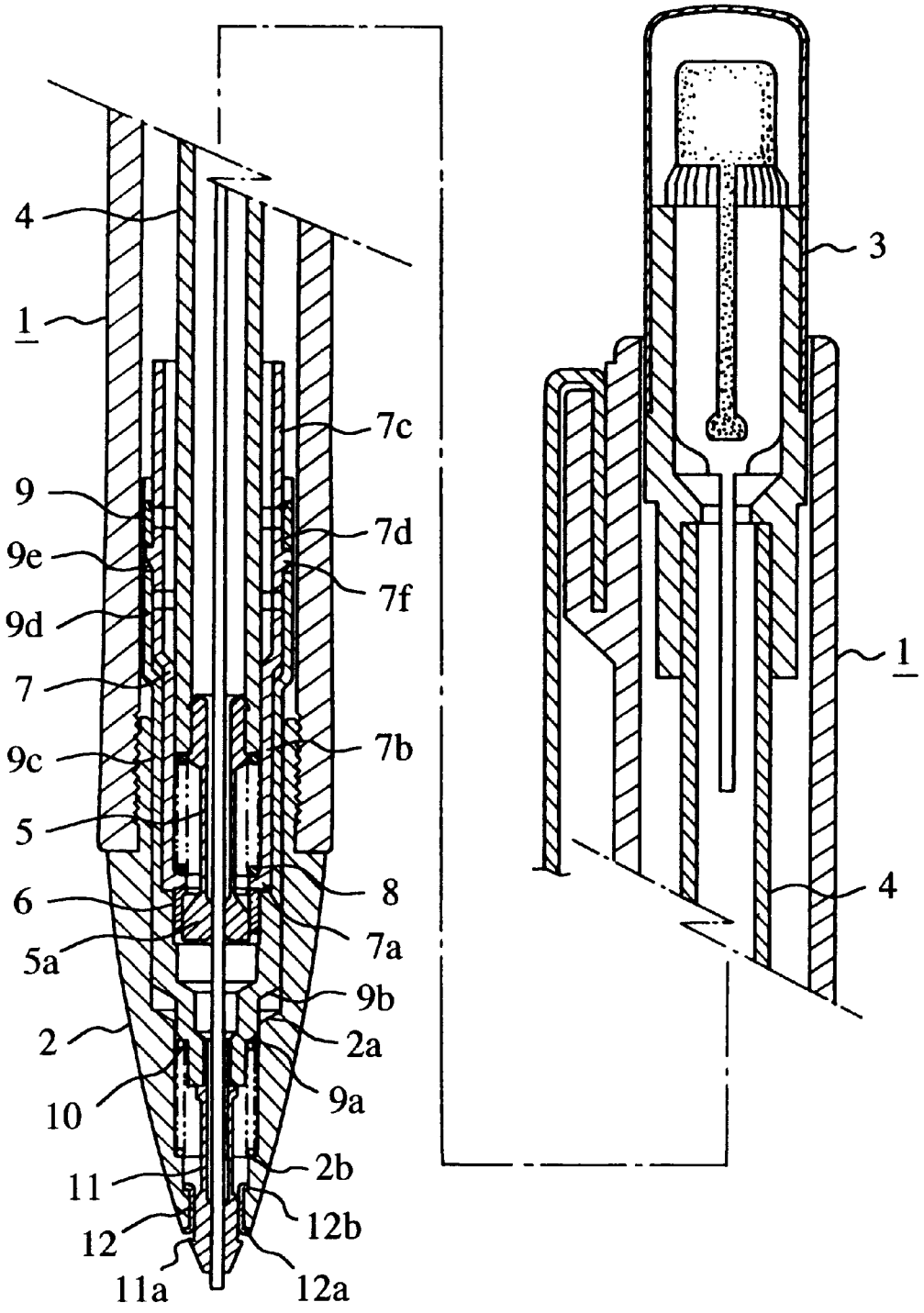
FIG. 2 is a longitudinal sectional view of a double chuck type mechanical pencil according to a first embodiment of this invention.
Figure 3:
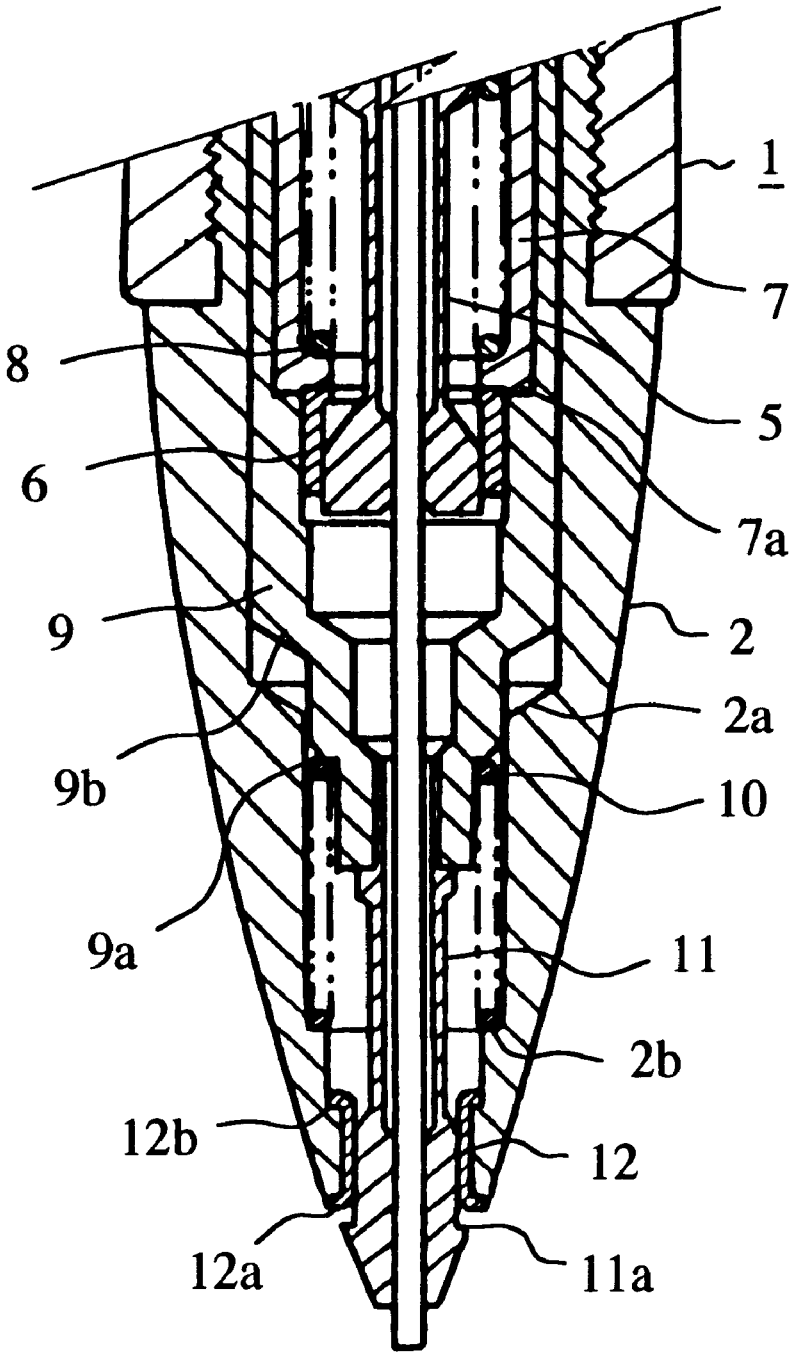
FIG. 3 is an enlarged sectional view of main parts of FIG. 2.

The embodiments of this invention will be described in detail hereinafter with reference to the accompanying drawings. FIG. 2 is a longitudinal sectional view of a double chuck type mechanical pencil according to a first embodiment of this invention. In the figure, a tip member 2 is removably screwed into an extreme end portion of an axial tube 1. This tip member is preferably formed particularly of synthetic resin in order to reduce the cost. A lead tank 4 is slidably provided in the axial tube 1. A knock member 3 such as an eraser holder for holding an eraser is detachably provided at the rear end portion of the lead tank 4. On the other hand, a rear chuck 5 is press-fitted in and secured to the extreme end portion of the lead tank 4, and a chuck ring 6 is loosely fitted on a chuck portion 5*a* of the rear chuck 5.

A rear spring 8 is interposed between a sleeve 7 as a connecting means in contact with the rear end of the chuck ring 6 and the front end of the lead tank 4. More particularly, the sleeve 7 has an inward flange 7*a* at the front end thereof, and the rear spring 8 as a resilient component is disposed internally of the flange 7*a*. The rear spring 8 biases the lead tank 4, etc., rearward.

The sleeve 7 is constructed as described in the following. The sleeve 7 comprises a front small-diameter portion 7*b*, a rear large-diameter portion 7*c* and an intermediate resilient portion 7*d* therebetween, forming a cushion sleeve as a whole. The intermediate resilient portion 7*d* has an axially expansible resilient function, for example, by means of plural slits formed on the sleeve 7 widthwise, and a pair of lock projections 7*f* are formed on the outer peripheral portion of the intermediate resilient portion 7*d*, and locked at a locking through-hole 9*e* of a coupling 9 described later.

Further, externally of the sleeve 7, the coupling 9 as a connecting means is provided in the form of a lock construction. More specifically, the coupling 9 is formed in its front portion with a small-diameter step portion 9*a*. An inclined shoulder 9*b* is provided at the rear of the small-diameter step portion 9*a*, and an intermediate diameter portion 9*c* is formed continuous thereto. A large diameter portion 9*d* is formed at the last portion, and the large diameter portion 9*d* is bored in the side wall thereof to form the locking through-hole 9*e*.

Further, a front spring 10 is interposed between the extreme end of the small-diameter step portion 9*a* of the coupling 9 and the inner wall portion of the tip member 2 to bias the coupling 9 rearward. It should be noted that in this embodiment, the force of the front spring 10 described later is set to be weaker than that of the rear spring 8 in view of operation. A front chuck 11 for holding a lead is press-fitted in and secured to the extreme end portion of the small-diameter step portion 9*a* of the coupling 9. Accordingly, there is an advantage that when the tip member 2 is removed, the front chuck 11 is not possibly dropped and lost.

The front chuck 11 is prepared by only a slitting process different from the rear chuck 5 which is prepared through the process of spread-open of the extreme end portion outward in a radial direction after the slitting process. The front chuck 11 is formed such that in a state where the front chuck set to the tip member 2 advances, it holds a lead to a degree of preventing the lead from falling off, but if a minute load is applied to a lead, the lead is capable of moving. A circumferential stopper projection 11*a* is formed at a part of the front chuck 11 which projects from the extreme end of the tip member 2.

The stopper projection 11*a* will be described in more detail. The front chuck 11 is opened outward and projected from the tip member 2 in a state where the front chuck 11 holds a lead as shown in the figure. On the other hand, in a state where the front chuck 11 does not hold a lead, the front chuck 11 is closed and retreated backward, but in which case, it will not move back more than as needed since the stopper projection 11*a* is present.

Figure 4:
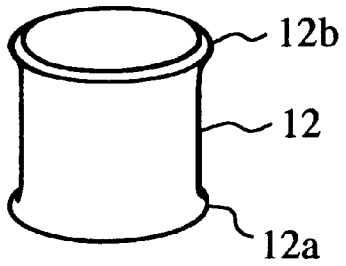
FIG. 4 is a perspective view showing a loosely fitted tube of FIG. 2.

A loosely fitted tube 12 is rotatably provided in an opening at the extreme end of the tip member 2. That is, in the loosely fitted tube 12, the circumferences of the front end and the rear end are spread out outward in a radial direction as will be apparent from FIG. 4 to form stopper portions 12*a* and 12*b*, respectively. Mounting of the loosely fitted tube 12 to the tip member 2 is done by loosely fitting it to the opening at the extreme end of the tip member 2 to a degree of preventing from being disengaged. Accordingly, the stopper portions 12*a* and 12*b* will suffice to be bent into an R shape gently outward instead of being bent at right angles.

Further, if a lubricating agent, for example, such as silicone, is provided between the inner periphery of the opening of the tip member 2 and the outer periphery of the loosely fitted tube 12, the loosely fitted tube 12 can be easily rotated relative to the tip member 2, thus enabling prevention of a lead held between the front chuck 11 and the rear chuck 5 from snapping off. That is, where the front chuck 11 and the rear chuck 5 hold a lead, when the front chuck 11 or the rear chuck 5 is rotated for some cause, the front chuck 11 and the rear chuck 5 are integrally and smoothly rotated since the loosely fitted tube 12 can be rotated relative to the axial tube and the tip member 2, thus avoiding twisting of a lead and preventing it from snapping off.

In a state where the front chuck 11 advances, the front chuck 11 is set to the tip member 2 in such a manner as to hold a lead to a degree of preventing it from falling off, but to allow the lead to move if a minute load is applied thereto. On the other hand, in a state where the front chuck 11 moves back, the front chuck 11 is set to the tip member 2 in such a manner as to have a holding force for holding a lead while withstanding writing pressure.

In the following, the operation of the mechanical pencil according to the first embodiment of the present invention will be described. First, in writing, when the knock member 3 at the rear end is knocked, the front spring 10 is first compressed because the front spring 10 is formed to be weaker than the rear spring 8. Then, the front chuck 11 is moved forward and opened to thereby enable receiving of a lead from the rear part.

Thereafter, the inclined shoulder portion 9*b* of the coupling 9 comes in contact with the step portion 2*a* formed internally of the tip member 2, and then the rear spring 8 is compressed so that the rear chuck 5 along with the lead tank 4 are moved forward. The chuck ring 6 comes in contact with the step portion formed internally of the coupling 9 during forward movement of the rear chuck 5 to open the rear chuck 5, and the lead moves forward by empty weight thereof and is held. Thereafter, when the knock is released, the rear chuck 5 returns to its initial position. Upon further knocking, the rear chuck 5 is moved forward, and moved forward within the coupling 9 while holding the lead to delivery the lead.

When the knock member 3 at the rear end is knocked, the front chuck 11 is moved forward through the lead tank 4, and thereafter, when the knock is released, the front chuck 11 is returned to its initial position by the bias force of the spring 10. At that time, since the loosely fitted tube 12 is interposed between the tip member 2 and the front chuck 11, the front chuck 11 does not directly impinge upon the tip member formed of synthetic resin, and the opening at the extreme end of the tip member 2 is not damaged due to the damping effect by the loosely fitted tube 12.

Where the lead becomes worn during writing, the knock member 3 at the rear end may be knocked again to move out the lead. Where the lead becomes shortened, the knocking operation is repeated to feed a new lead within the lead tank 4, and the worn lead can be pushed out by the new lead for further continuous use, thus minimizing a loss of a lead.

Where the lead is projected excessively from the front chuck 11, the knock member 3 at the rear end is pressed to slightly spread-open the chuck 11, after which the extreme end of the lead is pushed, then the lead can be moved back, thus enabling adjustment of the projecting length of the lead to prevent the lead from snapping off.

Also when the rear chuck 5 is accidentally rotated in a state where the lead is held between both the chucks 5 and 11, since both the chucks 5 and 11 are connected by the connecting means of the sleeve 7 and the coupling 9 and the loosely fitted tube 12 is provided rotatably relative to the tip member 2, both the chucks 5 and 11 are integrally rotated to prevent the lead from snapping off due to twisting.

Figure 7:
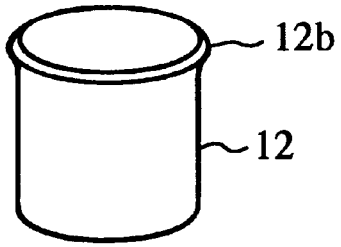
FIG. 7 is a perspective view showing a loosely fitted tube of FIG. 5.
Figure 5:
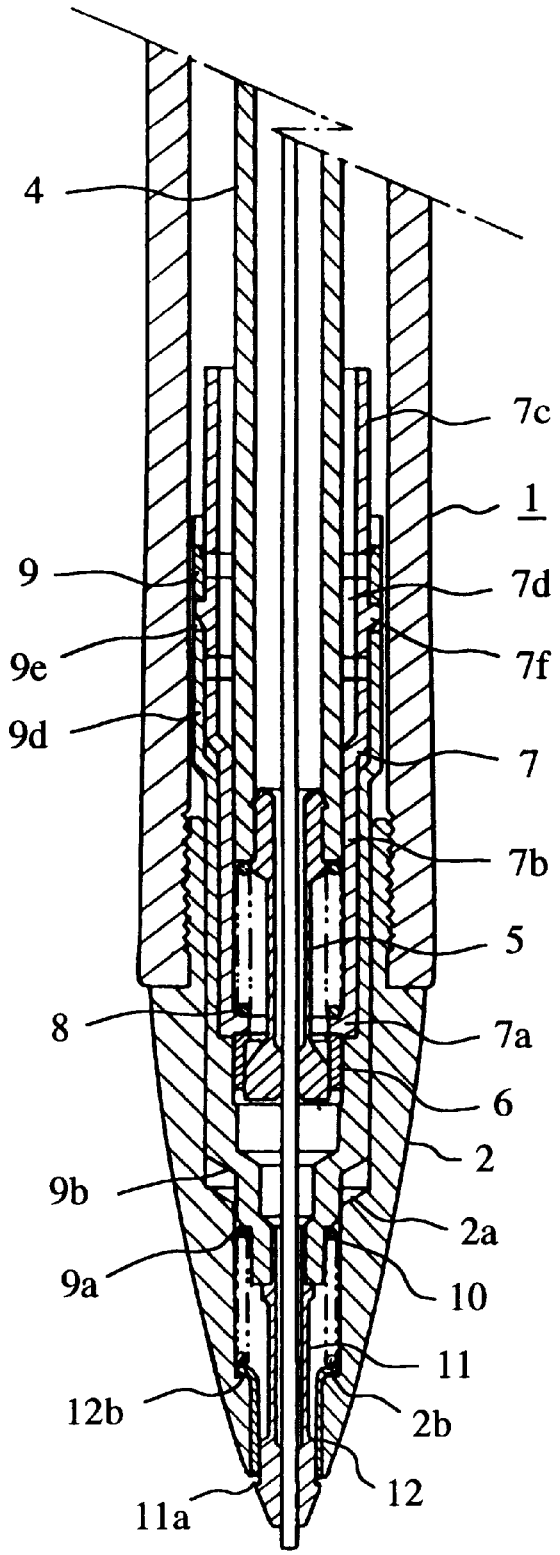
FIG. 5 is a longitudinal sectional view of a double chuck type mechanical pencil according to a second embodiment of this invention.
Figure 6:
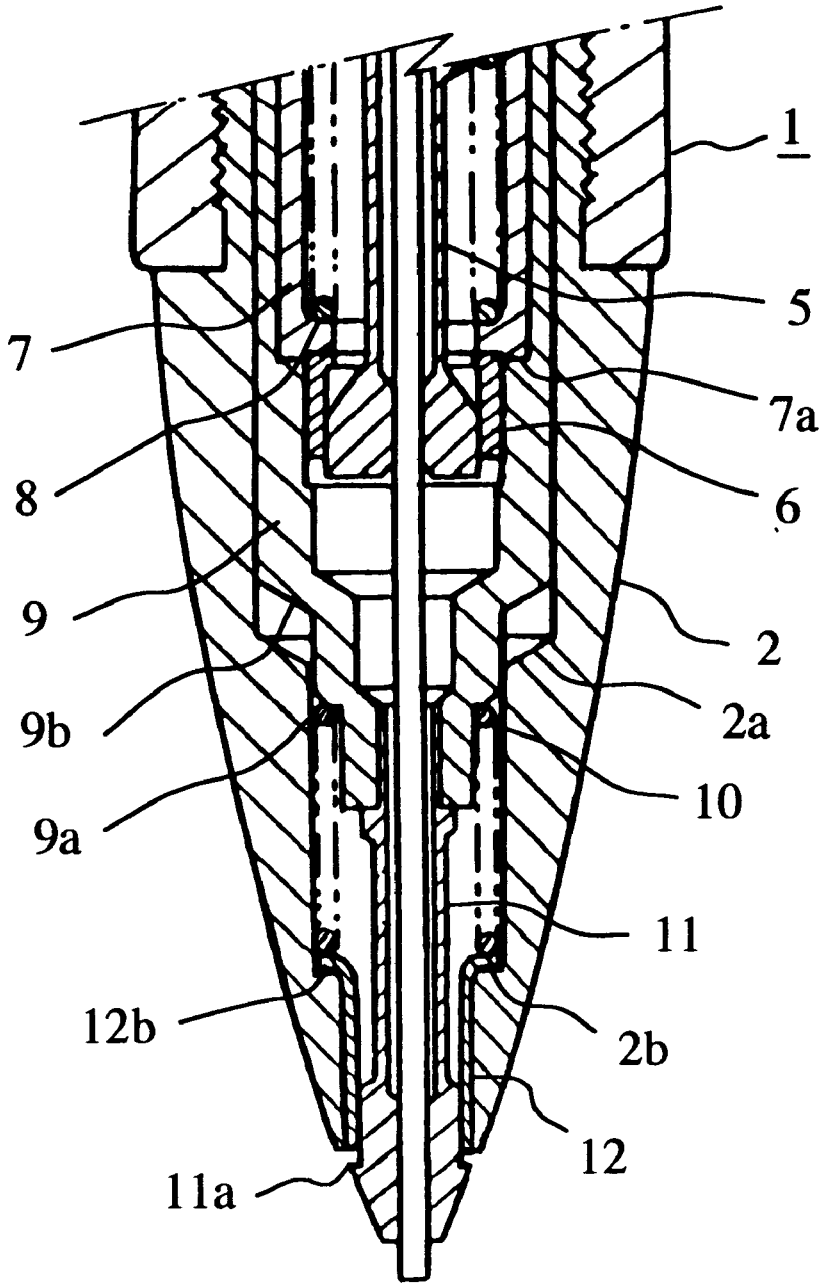
FIG. 6 is an enlarged sectional view of main parts of FIG. 5.

FIGS. 5–7 show a double chuck type mechanical pencil according to a second embodiment of this invention. In this embodiment, the loosely fitted tube 12 has only one stopper portion 12*b* provided at the rear end thereof, and one end of the spring 10 of the front chuck 11 is interposed between the stopper portion 12*b* at the rear end of the loosely fitted tube 12 and the step portion 9*a* of the coupling 9. The loosely fitted tube 12 is also mounted rotatably in the opening of the tip member 2 similarly to the above-described first embodiment, and a lubricating agent is provided between the inner periphery of the opening and the outer periphery of the loosely fitted tube 12 to facilitate rotation.

As will be apparent from the figures, since the loosely fitted tube 12 directly receives the spring 10 and is biased forward and pressed against the inner wall portion of the tip member 2, the stopper 12*b* may be formed merely at the rear end of the loosely fitted tube 12. Even by forming like this, the loosely fitted tube 12 is never disengaged from the opening of the tip member 2.

Figure 8:
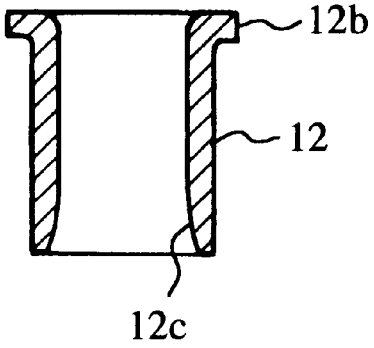
FIG. 8 is a sectional view showing a modified example of a loosely fitted tube of FIG. 5.

FIG. 8 shows a modified example of the loosely fitted tube 12. In this example, the front inner side of the loosely fitted tube 12 has an escape portion 12*c* having a so-called R shape in which the wall thickness of the inside of the extreme end is formed to be thinner gradually toward the front, in a relation with the front chuck 11. By forming like this, manipulation of fitting between the front chuck 11 and the loosely fitted tube 12 is further enhanced.

It is of course that the loosely fitted tube 12 is prepared by pressing metal having abrasion resistance, or by grinding, or by die casting molding. Since the tube 12 is very small as compared with the tip member 2, even use of a metal does not lead to increase the cost.

The double chuck type mechanical pencil according to this invention is constructed as described above. Since the loosely fitted tube is used, accuracy of fitting between the opening at the extreme end of the tip member and the front chuck is excellent; since a small loosely fitted tube will suffice, even use of a metal does not lead to increase the cost; the wear caused by impingement of the opening on the front chuck is prevented to simplify the manufacturing of the tip member; and since both the front and rear chucks are rotated together, there is obtained an effect of preventing a lead held by one chuck along with the other rotating chuck from snapping off due to twisting thereof.

What is claimed:

1. A double chuck type mechanical pencil comprising:

a lead tank slidably provided within an axial tube;

a rear chuck for drawing out a lead fixedly mounted on a front end of the lead tank;

a chuck ring loosely fitted around the rear chuck;

a rear resilient component for biasing rearward the lead tank and the rear chuck; and a front chuck for holding a lead connected to the rear chuck through a connecting means, wherein a front resilient component for biasing rearward the front chuck is disposed within a tip member provided in a front of the axial tube and a loosely fitted tube at least having a stopper portion at a rear end is provided in an opening portion of the tip member, and wherein a front portion of said front resilient component is placed in contact with and supported on the stopper portion of said loosely fitted tube.

2. A double chuck type mechanical pencil comprising:

a lead tank slidably provided within an axial tube;

a rear chuck for drawing out a lead fixedly mounted on a front end of the lead tank;

a chuck ring loosely fitted around the rear chuck;

a rear resilient component for biasing rearward the lead tank and the rear chuck; and a front chuck for holding a lead connected to the rear chuck through a connecting means, wherein a front resilient component for biasing rearward the front chuck is disposed within a tip member provided in a front of the axial tube, and a loosely fitted tube at least having a stopper portion at a rear end is provided in an opening portion of the tip member, and wherein said loosely fitted tube is provided rotatably relative to the tip member.

3. The double chuck type mechanical pencil according to claim 2, wherein a lubricating agent for smoothing rotation of said loosely fitted tube is provided between said loosely fitted tube and the opening of the tip member.

4. A double chuck type mechanical pencil comprising:

a lead tank slidably provided within an axial tube;

a rear chuck for drawing out a lead adapted to draw out a lead by slidably moving the lead tank;

a chuck ring loosely fitted around the rear chuck;

a rear resilient component for biasing rearward the lead tank and the rear chuck; and a front chuck for holding a lead provided in a front of the rear chuck, wherein a front resilient component for biasing rearward the front chuck is disposed within a tip member provided in a front of the axial tube, and a loosely fitted tube at least having a stopper portion at a rear end is rotatably provided in an opening portion of the tip member.

5. The double chuck type mechanical pencil according to claim 1, wherein said stopper portion of said loosely fitted tube is bent into an R-shape gently outward from the loosely fitted tube.

* * * * *